US005863388A

United States Patent [19]

Yeh et al.

[11] Patent Number: 5,863,388

[45] Date of Patent: Jan. 26, 1999

[54] BIODEGRADABLE AND WATER-RESISTANT PAPER PRODUCT

[75] Inventors: Wen-Fuei Yeh, Taichung; Long-Huei Wang, Tainan; Yao-Tung Liu, Pingtung; Ying-Yu Cheng, Tainan, all of Taiwan

[73] Assignee: Taiwan Sugar Corporation, Taipei, Taiwan

[21] Appl. No.: 559,537

[22] Filed: Nov. 16, 1995

Related U.S. Application Data

[63] Continuation of Ser. No. 370,489, Jan. 9, 1995, Pat. No. 5,618,387, which is a continuation-in-part of Ser. No. 174, 186, Dec. 27, 1993, abandoned.

[51] Int. Cl.[6] ..... D21J 1/04

[52] U.S. Cl. ..... 162/231; 162/179

[58] Field of Search ..... 428/34.2; 106/219, 106/243, 170.21, 170.41; 162/231, 218, 222, 179, 180

[56] References Cited

U.S. PATENT DOCUMENTS 1,345,476 7/1920 Clapp ..... 162/179

1,370,650 3/1921 Hoskins ..... 162/179

*Primary Examiner*—Brenda A. Lamb

*Attorney, Agent, or Firm*—Oppenheimer Wolff & Donnelly LLP

[57] ABSTRACT

A biodegradable and water-resistant paper product which has the compositions of 8–30% weight of a biodegradable and water-resistant agent selected from the group consisting of calcium stearate, cellulose stearate, calcium palmitate and cellulose palmitate, 92-70% weight of pulp, based on the sum of the dry weight of pulp and water-resistant agent; surfactant selected from the group consisting of rosin soap, sodium oleate, sodium stearate, and sodium palmitate; and aggregating agent as alum. The paper product is prepared by a method which includes the steps of: (a) preparing a pulp aqueous slurry at a consistency of about 4%; (b) adding surfactant to the slurry; (c) thereafter, adding between 8–30% weight of a biodegradable and water-resistant agent to the slurry to form a slurry mixture; (d) refining the slurry mixture at a consistency of about 4% to a desired drainage; (e) diluting the refined slurry mixture and adding an aggregating agent thereto to form a furnish; and (f) after step (e), forming the furnish to obtain biodegradable and water-resistant paper board or directly a paper utensil. The forming step can be through a hot-press at a temperature of 115° to 170° C.

6 Claims, No Drawings

BIODEGRADABLE AND WATER-RESISTANT PAPER PRODUCT

CROSS-REFERENCE TO RELATED APPLICATION

This application is a continuation application U.S. patent application Ser. No. 08/370,489, filed Jan. 9, 1995, now U.S. Pat. No. 5,618,387 which is a continuation-in-part of U.S. patent application Ser. No. 08/174,186, filed Dec. 27, 1993, now abandoned.

BACKGROUND OF THE INVENTION

The present invention is an improvement over the prior art for the following reasons. First, the prior art discloses a paper added with 0.5 to 1.5 wt % of water-resistant agent, such as calcium stearate or calcium palmitate, to adjust the printability of the paper. The dosage of the water-resistant agent cannot be greater, otherwise, the paper will contain too much oily material and cannot be written or printed on. However, the water-resistant agent, such as calcium stearate or calcium palmitate, used in this invention provides adhesive, molding and water-resistant effects after heating at a temperature of 115° to 170° C. Therefore, at least 8 wt % of the water-resistant agent should be used to achieve the above-mentioned unexpected results.

Furthermore, the present process for manufacturing the present utensil is characterized by the step of mixing the pulp, surfactant, like rosin soap and water-resistant agent orderly before the refining step. With this step, the water-resistant agent can be homogeneously dispersed on the surface of the pulp, and its retention rate is also significantly increased. Before the final product is obtained, the product should be hot pressed. Thereby, the water-resistant agent will melt to provide the water-resistant effect. In other words, the subject biodegradable paper utensil and the prior art water-proof paper are quite different in process, usage and purpose.

Recently, to overcome the environmental pollution problem caused by such non-degradable disposable utensils, effort and labor have been devoted to the development of naturally degradable materials, such as degradable polymers, for manufacturing degradable food containing utensils. However, such biodegradable plastic materials are either in experimental stages or are too expensive to commercialize. Therefore, some paper utensils have been used in order to prevent the contamination of the environment. However, utensils, such as paper lunch boxes, cups, and trays, were made with milk carton paper board, a paper sheet with polyethylene layer laminated on both sides thereof. However, the polyethylene is not naturally degradable and thus causes the environmental problem.

It is therefore desirable to provide a biodegradable utensil to overcome the above-mentioned problems.

SUMMARY OF THE INVENTION

An object of this invention is to provide paper utensils which are biodegradable and thus do not adversely affect the environment when disposed of.

Another object of this invention is to provide paper utensils and the preparing methods thereof which can eliminate the disadvantages of the prior art.

Accordingly, disclosed herein are a biodegradable paper utensil and a method of preparing same. The paper utensil is produced by pulp, surfactant like rosin soap, aggregating agent like alum and at least 8 wt % of biodegradable and water resistant agent selected from stearate, palmitate and the derivatives thereof. For example, the surfactant can be selected from the group consisting of rosin soap, sodium oleate, sodium stearate and sodium palmitate. The pulp is selected from the group consisting of non-wood plant pulp such as bagasse pulp, wood pulp such as nadelholz pulp. Before the final product is obtained, the product should be hot pressed at a temperature from 115° to 170° C. to melt the water-resistant agent dispersed therein to achieve the water-resistant, adhesive and molding effect. Therefore, the resulting paper utensil is usable, biodegradable and does not affect the environment.

DETAILED DESCRIPTION OF PREFERRED EMBODIMENTS OF THE INVENTION

In accordance with the present invention, there is provided a biodegradable paper utensil which is made of pulp, surfactant at least 8 wt % of biodegradable water-resistant agent and aggregating agent. The pulp is selected from the group consisting of non-wood plant pulp such as bagasse pulp, wood pulp such as nadelholz pulp. The amounts of surfactant and aggregating agent used are respectively in the range from 0 to 5 wt % based on the dry weight of the pulp used. The water-resistant agent used is selected from the group consisting of stearate, palmitate and derivatives thereof and the melting point thereof is from 130° to 160° C. Preferably, the water-resistant agent is selected from the group consisting of calcium stearate, cellulose stearate, calcium palmitate and cellulose palmitate. The surfactant is selected from the group consisting of rosin soap, sodium oleate, sodium stearate and sodium palmitate, and the aggregating agent is alum (aluminum sulfate).

One method of preparing a biodegradable paper utensil of this invention comprises the steps of: preparing a pulp aqueous slurry; adding 0 to 5 wt % of rosin soap as surfactant; adding at least 8 wt % of a biodegradable and water-resistant agent selected from the group consisting of calcium stearate, cellulose stearate, calcium palmitate and cellulose palmitate to the pulp aqueous slurry to form a slurry mixture; refining the slurry mixture to a desirable drainage; adding 0 to 5 wt % of alum as an aggregating agent to the slurry mixture; and forming the slurry mixture by a paper machine or a molding machine to obtain a dry intermediate product and hot pressing the intermediate product at a temperature of 115° to 170° C. to obtain a final product.

In accordance with an embodiment of the present invention, the paper product step comprises a wet-forming process, in which the pulp used is from 92 to 70 wt % and the amount of water-resistant agent used is from 8 to 30 wt %, the amount of the surfactant used is from 0.5 to 5 wt %, based on the dry weight of the pulp, and the amount of aggregating agent used is from 0.5 to 5 wt %, based on the dry weight of the pulp used. The pulp used in the pulp aqueous slurry is 15 to 85 wt % of bleached bagasse pulp and 85 to 15 wt % of nadelholz bleached kraft pulp. Alternatively, the pulp used can be composed of 15 to 85 wt % of laubholz bleached kraft pulp and 85 to 15 wt % of nadelholz bleached kraft pulp.

The forming step of the wet-forming process further comprises the steps of: (a) de-watering the slurry mixture to form a wet paper board or a wet molded paper mat; (b) drying the wet paper board or wet molded paper mat at a temperature of 90° to 100° C.; (c) hot pressing the dry paper board or dry molded paper mat provided by step (b) at a temperature from 115° to 170° C. to form a water-proof paper board or the molded paper utensil directly; and (d) processing the paper board provided by step (c) to form the desired paper utensil.

Alternatively, the present invention can comprise a dry-forming process. The amount of pulp used is from 25 to 75 wt %, and the amount of water-resistant agent used is from 75 to 25 wt %. The pulp used in this process is composed of 15 to 85 wt % of bleached bagasse pulp and 85 to 15 wt % of nadelholz bleached kraft pulp. Furthermore, the pulp used can be composed of 15 to 85 wt % of laubholz bleached kraft pulp and 85 to 15 wt % of nadelholz bleached kraft pulp.

The forming step for the dry-forming process comprises the following steps: (a) de-watering the slurry mixture to form a dry, molded, soft paper board having a density from 0.25 to 0.5 g/cm$^3$; (b) preheating the moldable paper board obtained in step (a) at a temperature of 110° to 170° C. to soften it; and (c) hot-pressing the moldable paper board obtained in step (b) in a mold at a temperature from 115° to 170° C. to obtain a molded paper utensil.

The present invention will now be described more specifically with reference to the following embodiments. The following description of the embodiments is simply for the purpose of illustration and description and is not intended to be exhaustive or to limit the invention to the precise forms or methods disclosed.

EXAMPLE 1

The amount of the pulp, the surfactant, the aggregating agent and the water-resistant agent used in the present example are respectively listed in Table 1. During the preparing process, the pulp is dispersed in water and rosin soap as a surfactant, the water-resistant agent are added to the pulp aqueous slurry to form a slurry mixture. After refining the slurry mixture and adding the aggregating agent like alum, a utensil mold is immersed in the slurry mixture to adsorb the furnish thereon. After the de-watering and the drying step, the molded dry mat produced is further hot-pressed at a temperature of from 115° to 170° C. to obtain the paper utensil.

Alternatively, the furnish can be sheet formed firstly to make a dry paper board, an intermediate, as usual ways and then it is hot-pressed at a temperature of 115° to 117° C. to form a water-resistant paper board. The board is then processed to obtain the paper utensil.

TABLE 1

| RUNS NO. | water-resistant agent: calcium stearate (%) | water-resistant agent: calcium palmitate (%) | pulp amount (%) | pulp amount (%) | pulp: bleached bagasse pulp (%) | pulp: nadelholz bleached kraft pulp (%) | surfactant (rosin soap) (%) | aggregating agent (alum) (%) |
|---|---|---|---|---|---|---|---|---|
| 1 | 7.5 | 0 | 92.5 | 20 | 80 | 2.0 | | 2.5 |
| 2 | 12.5 | 0 | 87.5 | 30 | 70 | 2.5 | | 3.0 |
| 3 | 17.5 | 0 | 82.5 | 45 | 55 | 3.0 | | 3.5 |
| 4 | 22.5 | 0 | 77.5 | 60 | 40 | 3.5 | | 4.0 |
| 5 | 27.5 | 0 | 72.5 | 80 | 20 | 4.0 | | 4.5 |
| 6 | 0 | 7.5 | 92.5 | 20 | 80 | 2.0 | | 2.5 |
| 7 | 0 | 12.5 | 87.5 | 30 | 70 | 2.5 | | 3.0 |
| 8 | 0 | 17.5 | 82.5 | 45 | 55 | 3.0 | | 3.5 |
| 9 | 0 | 22.5 | 77.5 | 60 | 40 | 3.5 | | 4.0 |
| 10 | 0 | 27.5 | 72.5 | 80 | 20 | 4.0 | | 4.5 |
| 11 | 3.75 | 3.75 | 92.5 | 20 | 80 | 2.0 | | 2.5 |
| 12 | 6.25 | 6.25 | 87.5 | 30 | 70 | 2.5 | | 3.0 |
| 13 | 8.75 | 8.75 | 82.5 | 45 | 55 | 3.0 | | 3.5 |
| 14 | 11.25 | 11.25 | 77.5 | 60 | 40 | 3.5 | | 4.0 |
| 15 | 13.75 | 13.75 | 72.5 | 80 | 20 | 4.0 | | 4.5 |

The water resistant rates of the paper utensil produced have been tested and are listed in Table 2 below.

TABLE 2

| RUNS NO. | HOT PRESSED CONDITIONS: PAPER SHEET temp (°C.) | PAPER SHEET pressure (KG/cm$^2$) | PAPER SHEET time (sec) | SLURRY FILM temp (°C.) | SLURRY FILM pressure (KG/cm$^2$) | SLURRY FILM time (sec) | WATER RESISTANT RATE (%) |
|---|---|---|---|---|---|---|---|
| 1 | 165 | 19 | 5–60 | 160 | 4–8 | 60–165 | 61.5 |
| 2 | 165 | 11 | 5–60 | 160 | 4–8 | 60–165 | 98.0 |
| 3 | 165 | 15 | 5–60 | 160 | 4–8 | 60–165 | 98.0 |
| 4 | 165 | 15 | 5–60 | 160 | 4–8 | 60–165 | 98.0 |
| 5 | 165 | 15 | 5–60 | 160 | 4–8 | 60–165 | 98.0 |
| 6 | 150 | 15 | 5–60 | 150 | 4–8 | 60–165 | 58.0 |
| 7 | 150 | 15 | 5–60 | 150 | 4–8 | 60–165 | 98.0 |
| 8 | 150 | 15 | 5–60 | 150 | 4–8 | 60–165 | 98.0 |
| 9 | 150 | 15 | 5–60 | 150 | 4–8 | 60–165 | 98.0 |
| 10 | 150 | 15 | 5–60 | 150 | 4–8 | 60–165 | 98.0 |
| 11 | 155 | 15 | 5–60 | 155 | 4–8 | 60–165 | 60.0 |
| 12 | 155 | 15 | 5–60 | 155 | 4–8 | 60–165 | 98.0 |
| 13 | 155 | 15 | 5–60 | 155 | 4–8 | 60–165 | 98.0 |
| 14 | 155 | 15 | 5–60 | 155 | 4–8 | 60–165 | 98.0 |
| 15 | 155 | 15 | 5–60 | 155 | 4–8 | 60–165 | 98.0 |

The biodegradable effect for the utensil produced is listed in Table 3. The utensil for test A was produced by this invention and was buried in soil. The utensil for test A' was an imported milk carton paper board with both sides polyethylene film laminated and was also buried in soil. The utensil for test B was produced by this invention and was immersed in sewage. The utensil for test B' was an imported milk carton paper board with both sides polyethylene film laminated and was also immersed in sewage.

TABLE 3

| THE WEIGHT CHANGE FOR THE UTENSIL | | | | | | | | | | | | |
|---|---|---|---|---|---|---|---|---|---|---|---|---|
| TEST | 45 days | | 75 days | | 120 days | | 165 days | | 210 days | | 270 days | |
| ITEM | g | (%) | g | (%) | g | (%) | g | (%) | g | (%) | g | (%) |
| A | 6.4 | 73 | 3.7 | 42 | 1.2 | 13 | 0.4 | 4 | 0 | 0 | — | — |
| A' | 7.6 | 86 | 6.4 | 73 | 5.4 | 61 | 4.0 | 45 | 2.1 | 24 | 1.7 | 8 |
| B | 4.0 | 91 | 2.3 | 52 | 0.9 | 20 | 0.6 | 14 | 0.3 | 7 | 0 | 0 |
| B' | 4.1 | 94 | 3.7 | 84 | 3.2 | 73 | 2.5 | 57 | 1.6 | 36 | 0.5 | 11 |

EXAMPLE 2

This shows how a moldable paper board and a utensil are made. The amount of the pulp, surfactant, the water-resistant agent and the aggregating agent used in the present example are respectively listed in Table 4. During the preparing process, the pulp is dispersed in water and rosin soap as surfactant and the water-resistant agent are added to the pulp aqueous slurry to form a slurry mixture of about 4% consistency. After refining and diluting the furnish, a soft moldable paper board with the density of 0.25 to 0.5 g/cm$^3$ was formed and dried at a temperature of from 90° to 100° C. Then, the paper board was preheated at a temperature of from 110° to 170° C. for 2 to 40 seconds to soften the board and hot-pressed by a hot mold to form the paper utensil.

TABLE 4

| | water-resistant agent | | pulp | | | surfactant (rosin soap) | |
|---|---|---|---|---|---|---|---|
| RUNS | calcium stearate | calcium palmitate | amount | | bleached bagasse pulp | nadelholz bleached kraft pulp | aggregating agent (alum) |
| NO. | (%) | (%) | (%) | (%) | (%) | (%) | (%) |
| 1 | 30 | 0 | 70 | 40 | 60 | 4.0 | 4.0 |
| 2 | 40 | 0 | 60 | 50 | 50 | 4.0 | 4.0 |
| 3 | 50 | 0 | 50 | 70 | 30 | 5.0 | 5.0 |
| 4 | 60 | 0 | 40 | 85 | 15 | 5.0 | 5.0 |
| 5 | 0 | 30 | 70 | 40 | 60 | 4.0 | 4.0 |
| 6 | 0 | 40 | 60 | 50 | 50 | 4.0 | 4.0 |
| 7 | 0 | 50 | 50 | 60 | 30 | 5.0 | 5.0 |
| 8 | 0 | 60 | 40 | 85 | 15 | 5.0 | 5.0 |
| 9 | 15 | 15 | 70 | 40 | 60 | 4.0 | 4.0 |
| 10 | 20 | 20 | 60 | 50 | 50 | 4.0 | 4.0 |
| 11 | 25 | 25 | 50 | 70 | 30 | 5.0 | 5.0 |
| 12 | 30 | 30 | 40 | 85 | 15 | 5.0 | 5.0 |

The product appearances of the paper utensil produced were tested and are listed in Table 5.

TABLE 5

| Run No. | Pre-heating temp (°C.) | Hot-pressing temp (°C.) | Hot-pressing pressure (KG/cm$^2$) | Hot-pressing time (SEC) | Product appearance |
|---|---|---|---|---|---|
| 1 | 150 | 165 | 25 | 6 | NO WRINKLES |
| 2 | 150 | 165 | 20 | 5 | NO WRINKLES |
| 3 | 150 | 165 | 17 | 4 | NO WRINKLES |
| 4 | 150 | 165 | 15 | 4 | NO WRINKLES |

TABLE 5-continued

| Run No. | Pre-heating temp (°C.) | Hot-pressing temp (°C.) | Hot-pressing pressure (KG/cm$^2$) | Hot-pressing time (SEC) | Product appearance |
|---|---|---|---|---|---|
| 5 | 125 | 150 | 25 | 6 | NO WRINKLES |
| 6 | 125 | 150 | 20 | 5 | NO WRINKLES |
| 7 | 125 | 150 | 17 | 4 | NO WRINKLES |
| 8 | 125 | 150 | 15 | 4 | NO WRINKLES |

TABLE 5-continued

| Run No. | Pre-heating temp (°C.) | Hot-pressing temp (°C.) | Hot-pressing pressure (KG/cm$^2$) | Hot-pressing time (SEC) | Product appearance |
|---|---|---|---|---|---|
| 9 | 135 | 155 | 25 | 6 | NO WRINKLES |
| 10 | 135 | 155 | 20 | 5 | NO WRINKLES |
| 11 | 135 | 155 | 17 | 4 | NO WRINKLES |
| 12 | 135 | 155 | 15 | 4 | NO WRINKLES |

From the foregoing detailed description, it will be evident that there are a number of changes, adaptations and modifications of the present invention which come within the province of those skilled in the art. However, it is intended that all such variations not departing from the spirit of the invention be considered as within the scope thereof as limited solely by the claims appended hereto.

What is claimed is:

1. A biodegradable, water-resistant paper board formed by a process comprising the steps of:

preparing a pulp aqueous slurry at a consistency of about 4%;

adding surfactant selected from the group consisting of rosin soap, sodium oleate, sodium stearate, and sodium palmitate to the pulp aqueous slurry;

after said surfactant adding step, adding between 8–30% weight of a biodegradable and water-resistant agent selected from the group consisting of calcium stearate, cellulose stearate, calcium palmitate and cellulose palmitate to the pulp aqueous slurry to form a slurry mixture;

refining the slurry mixture at a consistency of about 4% to a desired drainage;

diluting the refined slurry mixture and adding thereto an aggregating agent as alum to form a furnish; and after said diluting and adding step, forming the furnish to obtain a biodegradable, water-resistant paper board through a hot pressing at a temperature from 115° to 170° C.

2. A biodegradable, water-resistant paper board as claimed in claim 1, wherein the paper board of said forming step comprises a paper utensil.

3. A biodegradable, water-resistant paper board as claimed in claim 1, wherein said forming step is a wet forming step.

4. A biodegradable, water-resistant paper board as claimed in claim 3 wherein the composition of the slurry mixture before said refining is 92-70 weight percent pulp and 8–30 weight percent water-resistant agent, based on the sum of the dry weight of pulp and water-resistant agent, and the composition of the surfactant as rosin soap is 05.-5 weight percent, of the aggregating agent as alum is 0.5–5 weight percent, based on the dry weight of pulp only.

5. A biodegradable, water-resistant paper board as claimed in claim 4 wherein the composition of the pulp is 15–85 weight percent bleached bagasse pulp and 85-15 weight percent nadelholtz bleached kraft pulp.

6. A biodegradable, water-resistant paper board as claimed in claim 4 wherein the composition of the pulp is 15–85 weight percent laubholt kraft pulp and 85-15 weight percent nadelholtz bleached kraft pulp.

* * * * *